US005370290A

United States Patent [19]

Gilliland

[11] Patent Number: 5,370,290

[45] Date of Patent: Dec. 6, 1994

[54] WIRE FEEDER ALLOWING FOR WIRE SLIPPAGE WITHOUT DAMAGING WIRE

[76] Inventor: Malcolm T. Gilliland, 310 Pine Valley Rd., Marietta, Ga. 30067

[21] Appl. No.: 834,679

[22] Filed: Feb. 12, 1992

[51] Int. Cl.[5] ..... B65H 51/10; B65H 51/12; B65H 51/32

[52] U.S. Cl. ..... 226/108; 226/177; 226/186; 226/188; 226/190

[58] Field of Search ..... 226/181–183, 226/188, 108, 112, 10, 1, 4, 168, 176, 177, 186, 187, 190

[56] References Cited

U.S. PATENT DOCUMENTS

| | | | |
|---|---|---|---|
| 3,288,337 | 11/1966 | Van Bergen et al. | 226/181 |
| 3,586,221 | 6/1971 | Rosen | 226/108 X |
| 3,630,425 | 12/1971 | Wilkens | 226/108 |
| 3,672,655 | 6/1972 | Carter | 226/108 |
| 3,693,858 | 9/1972 | Araya et al. | 226/108 |
| 3,901,425 | 8/1975 | Taylor et al. | 226/108 |
| 4,085,880 | 4/1978 | Samokovliski et al. | 226/181 X |
| 4,266,709 | 5/1981 | Kruger | 226/181 |
| 4,790,164 | 12/1988 | Rohe | 226/182 X |
| 5,109,690 | 5/1992 | Taniguchi et al. | 226/182 X |

*Primary Examiner*—Stanley N. Gilreath
*Attorney, Agent, or Firm*—Jones & Askew

[57] ABSTRACT

A pusher system (12) extracts a wire (11) from a reservoir (10) and feeds the wire through a wire guide (13) to a puller system (14). The puller system then feeds the wire (11) through a tip (15) to the welding operation represented by an arc (16) and a work piece (17). The pusher system (12) has a motor (20) adjusted so as to feed the wire (11) at the desired rate. A pair of rollers (22), which are driven by the motor (20), are designed to slip on the wire (11) if the wire becomes jammed or blocked. The puller system (14) has a limited torque motor (30). The limited torque motor (30) drives a pair of rollers (32) which firmly grip the wire (11) and do not slip on the wire (11). If the wire (11) becomes blocked or jammed then the motor (30) will stall. The combination of the pusher system (12) and the puller system (14) provides a wire feeder which does not damage the wire (11) and which does not cause birdnesting if the wire is jammed or blocked.

6 Claims, 2 Drawing Sheets

WIRE FEEDER ALLOWING FOR WIRE SLIPPAGE WITHOUT DAMAGING WIRE

TECHNICAL FIELD

This invention relates to a wire feeder apparatus for feeding a consumable wire electrode to a welding operation and to a method for adjusting the wire feeder to avoid jamming or "birdnesting".

BACKGROUND OF THE INVENTION

In welding processes, wherein a consumable wire forms the electrode and supplies the filler metal, there is often a problem with feeding the wire. Where the distance between the wire reel or spool and the arc is reasonably short, and where the wire has good column strength, the wire feed problem is minimized. However, in many welding applications, wire is removed from a wire reel or reservoir and fed into the arc welding operation at a point which is a considerable distance from the wire reel. In traversing the path extending from the wire reel to the arc, the wire is sometimes passed through wire guides of one form or another such as eyes, conduit, or hollow flexible cables, which may or may not be lined with a friction reducing liner. In many cases, this can be done without too much difficulty but in other cases there are problems. For example, where the distance between the wire reel and the arc is large, or where there are significant bends in the wire guide, it becomes necessary to use a "pusher" system near the wire reel to pull the wire from the wire reel and push the wire into the wire guide, and a "puller" system near the arc, typically in the welding gun, to pull the wire from the wire guide and feed the wire to the arc welding operation.

Where the wire is pushed, it may collapse as a column, jam in the wire guide, wrap around the drive rolls, or cause the drive rolls to slip with respect to the wire, thus stalling the wire feed or causing the wire to feed in an erratic manner. Where serrated rolls are used, slippage of the drive rolls with respect to the wire may cause the drive rolls to mill the wire. Where the wire is pulled, excessive drag in the wire guide may cause the wire to break from the tension, slip or stall the wire feed system, or cause the rolls to mill the wire. These problems are further aggravated where a small diameter wire is used, especially where soft wire such as aluminum wire is used or where bends in the wire guide cause excessive friction.

The pusher system and the puller system should both feed at the same rate. If the pusher system attempts to feed wire at a higher rate than the puller system attempts to pull the wire the wire may collapse in the wire guide, may wrap around the drive rolls, or cause the drive rolls to slip, thereby galling or milling the wire. If the puller system is faster than the pusher system the tension may be excessive and cause the wire to break or the drive rolls on one or both of the systems may slip. If the drive rolls slip the wire may alternately feed at the speed of the pusher system and then at the speed of the puller system. The problem is further aggravated if any attempt is made to vary the wire feed speed because it is very difficult to match the speeds of the two drive systems over any appreciable range.

To avoid this problem some prior systems use a speed adjustable motor for one system and a constant torque motor for the other system. Such a wire feeder is described in U.S. Pat. No. 3,293,477.

However, it is still found that the wire may occasionally collapse as a column, jam in the wire guide, wrap around the feed rolls, or slip with respect to the drive rolls. This occurs when the tip in the welding gun as jammed so that the wire cannot feed from the welding gun. This problem happens more frequently with soft, small diameter wire, such as aluminum.

Five conditions create the majority of jamming problems. First, the wire can burn back and weld itself to the end of the tip. Second, fine weld splatter can splash back out of a welding puddle and can clog the outlet of the tip and restrict the wire feed. Eventually, the diameter of the hole of the tip becomes reduced from the splatter to the point where the wire stops feeding or at least encounters a substantial amount of friction. Third, as a result of wire going through the wire guide and being pushed or pulled through the mechanism and various openings, small wire shavings form, especially when knurled or serrated rollers are used. The movement of the wire draws the shavings and powder into the tip and, eventually, a wedge may form inside the tip which substantially increases the friction of the wire going through the tip or may stop the wire entirely. Fourth, a poor electrical contact between the tip and the wire may cause the wire to melt inside the tip. This melted area may then immediately resolidify inside the tip, bind to the tip, and prevent the wire from coming out. Fifth, a form of etching or corrosion can take place inside the tip due to current transfer between the tip and the wire. Material is pulled from the tip, the wire, or both, to produce particles which build up inside the tip and restrict or reduce the size of the opening in the tip.

If any of these conditions occur then, when the welding operator next pulls the trigger, the pusher and puller systems will attempt to feed the wire. If the puller system is not a limited torque system then the wire may deform and spool out inside the welding gun. If the driver is not a limited torque system then the wire may collapse in the wire guide, jam in the wire guide, and/or spool out into the pusher mechanism. Although collapsing or jamming of the wire is a problem in and of itself, the spooling of the wire into the various mechanisms is a major problem because the welding operator must then take the time to cut and pull the wire out of the mechanism, thereby wasting a substantial amount of time.

When the trigger is pulled, the wire may feed out of the welding gun at a rapid rate if there is any slack in the wire. This can cause the wire to feed at a high rate until the slack is taken out. The wire can strike the workpiece, causing a high striking current which can cause burn-through of thin material, stubbing if there is insufficient power to strike the arc, or wire burn-through, which can cause the arc to strike and burn back to the tip.

Therefore, there is a need for a wire feeder which properly feeds wire to a welding operation but does not feed wire when a blockage occurs.

There is also a need for a method of adjusting a wire feeder so that the wire feeder will properly feed wire to a welding operation but will not feed wire when a blockage occurs.

There is also a need for a wire feeder which will maintain the wire in tension at all times.

SUMMARY OF THE INVENTION

The present invention is a wire feeder which properly feeds wire at a desired rate to a welding operation but will not feed wire when a blockage occurs. Also, the present invention is a method for adjusting a wire feeder so that the wire feeder will properly feed wire to a welding operation but will not feed wire where a blockage occurs.

More particularly described, the wire feeder comprises a pusher system and a puller system, each system having a pair of rollers. At least one of the rollers on the pusher system has a groove which precisely fits the wire. Furthermore, the rollers are polished to a very fine smoothness so that the rollers do not deform or damage the wire when the rollers are slipping on the wire. The torque for the motor is adjusted to feed the wire at the desired rate and the pressure that the rollers exert on the wire is adjusted so that the rollers slip on the wire if a blockage occurs. The pusher system can be used alone or with a puller system.

At least one of the rollers for the puller system has a V-groove for firmly gripping the wire. The pressure that the rollers exert on the wire is adjusted so that the rollers neither deform the wire nor slip on the wire. The torque for the motor in the puller system is adjusted so that the wire feeds at the desired rate when the tip is not blocked but the motor stalls when the tip is blocked.

The pusher system is therefore adjusted so that it does not stall, but will slip on the wire, and the puller system is adjusted so that it will not slip on the wire, but will stall. The combination provides a wire feeder which is less susceptible to jamming.

The braking resistors of the pusher system and the puller system are adjusted so that the pusher system stops faster than the puller system. This maintains the wire in tension and prevents the wire from striking the workpiece when the trigger is pulled.

Therefore, it is an object of the present invention to provide a wire feeder system which will feed a wire at a desired rate when a blockage is not present but will not feed the wire when a blockage is present.

It is another object of the present invention to provide a wire feeder which maintains tension on the wire.

It is another object of the present invention to provide a wire feeder which will not damage the wire.

It is another object of the present invention to provide a method for adjusting a wire feeder so that wire is fed at the desired rate if a blockage is not present but wire is not fed if a blockage is present.

It is another object of the present to provide a method for adjusting a wire feeder so as to prevent the wire from collapsing in the wire guide or forming birdnests when a jam or blockage occurs.

DETAILED DESCRIPTION

Figure 1:
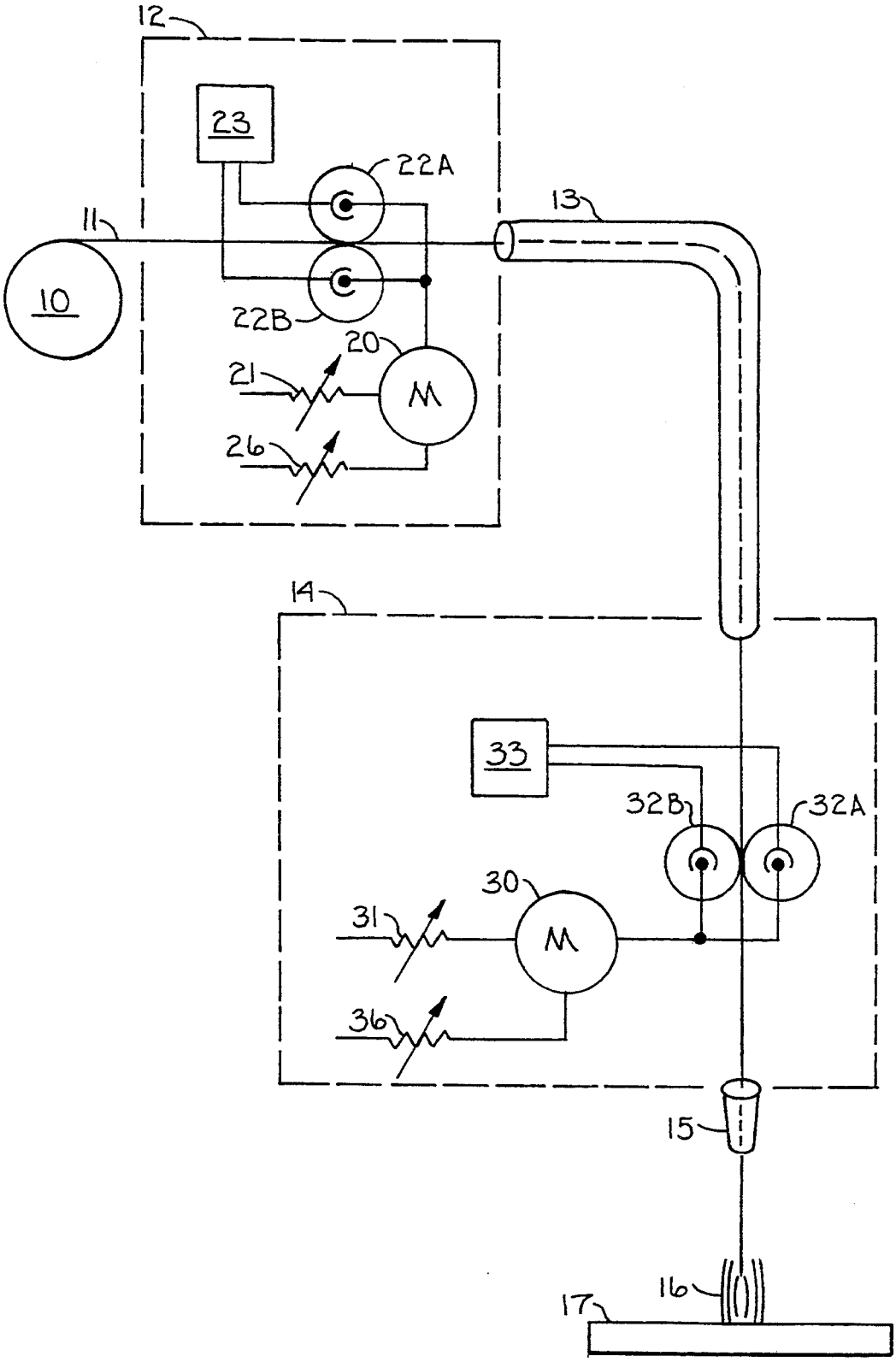
FIG. 1 is an illustration of the preferred embodiment of the present invention.

Turn now to the drawing, in which like numerals represent like components throughout the several figures. FIG. 1 is an illustration of the preferred embodiment of the present invention. A pusher system 12 pulls wire 11 from a wire reservoir or a wire spool 10 and pushes wire 11 through wire guide 13 toward puller system 14. Wire guide 13 is conveniently made of spring steel, with a nylon or teflon inner liner to reduce friction between the wire 11 and the wire guide 13. Reservoir 10 and wire guide 13 are well known in the art. Puller system 14 pulls wire 11 from wire guide 13 and feeds wire 11 through tip 15 to arc 16 for operation on workpiece 17.

Pusher system 12 contains a motor 20, a motor control device 21, rollers 22A and 22B, a pressure control device 23, and a braking resistor 26. Motor control device 21 is well known in the art. Motor control device 21 is adjusted so that pusher system 12 feeds wire 11 to the arc welding operation at the desired rate. The size and rating of motor 20 is not critical except that motor 20 should have sufficient capacity to push wire 11 at the desired rate through wire guide 13 and tip 15. Motor 20 drives rollers 22A and 22B. The longitudinal axes of rollers 22A and 22B are in parallel. Motor 20 may directly drive both rollers 22 or rollers 22A and 22B may be geared together and motor 20 drives a selected one of the rollers 22. The construction of rollers 22 is critical and is described hereinbelow. Wire 11 passes between rollers 22. Pressure control device 23 controls the pressure that rollers 22 exert on wire 11. The construction of pressure control device 23 is not critical and is well known in the art. For example, see U.S. Pat. No. 3,107,291. However, the adjustment of pressure control device 23 is critical. Pressure control device 23 must cause rollers 22 to exert sufficient pressure on wire 11 that wire 11 is gripped and fed, without deformation, at the desired rate when a jam or blockage is not present. However, the pressure exerted must be sufficiently small to allow rollers 22 to slip on wire 11 if a jam or blockage occurs. If the pressure is too great and a jam or blockage occurs, rollers 22 will not slip on wire 11 and pusher system 12 will continue to feed wire into column 13. If this occurs then wire 11 may collapse and jam in column 13 or the wire 11 may spool out and birdnesting occur in pusher system 12 or puller system 14 or both, depending upon where the jam or blockage occurs.

Puller system 14 comprises a motor 30, a motor control device 31, rollers 32A and 32B, and a pressure control device 33. It is preferred that motor 20 and pusher system 12 provide the greater amount of the power required to move wire 11 from reservoir 10 to the arc 16. This allows motor 30, which is typically in the welding gun, to be smaller and lighter and therefore more convenient for the welding operator to use. Motor control device 31 is adjusted so that wire 11 feeds at the desired rate when a jam or blockage is not present and so that motor 30 will stall out when a jam or blockage is present. In the preferred embodiment, motor control device 31 is a rheostat connected in series with motor 30 and it limits the available current for motor 30. If wire 11 jams then, because of the limited current available, motor 30 will stall. Wire 11 passes between rollers 32A and 32B and is fed by rollers 32 through tip 15 to the arc 16. The longitudinal axes of rollers 32A and 32B are in parallel. Pressure control device 23 adjusts the pressure that rollers 32 exert on wire 11. The construction of rollers 32 is critical and is described in more detail hereinbelow. The adjustment of pressure control device 23 is also critical. In order to minimize damage to or deformation of wire 11, rollers 32 should not slip on wire 11. In the preferred embodiment, rollers 32 are not as finely polished as rollers 22. If rollers 32 slip on wire 11 then galling or other damage to wire 11 may occur. Because pressure control device 33 is adjusted so that rollers 32 will not slip on wire 11, motor control device 31 is adjusted so that motor 30 will stall when wire 11 becomes jammed.

In the preferred embodiment, it is also preferred that wire 11 always remain in tension between pusher system 12 and puller 14. If wire 11 is maintained in tension then the likelihood of wire 11 jamming or collapsing in column 13 is minimized. Therefore, motor 30 should start before motor 20 so that motor 30 pulls out any slack in wire 11 that may exist, especially any slack in column 13. Furthermore, motor 20 should stop before motor 30 so as to maintain wire 11 in tension when a welding operation is not in progress. U.S. Pat. No. 3,293,477 discloses a wire feeder which starts the puller system before starting the pusher system and stops the pusher system before stopping the puller system.

Furthermore, it is preferable that motor 20 brakes at a faster rate than motor 30 brakes. This further assures that wire 11 will remain in tension. This is described more fully hereinbelow.

However, it will be appreciated that motor 30 must have sufficient torque and speed so that the no load speed of motor 30 is faster than the speed at which it is desired to operate when it is pulling wire 11. If the no load rating of motor 30 is insufficient or if motor control device 31 is set to provide too low a torque for motor 30, then motor 30 will not be able to maintain wire 11 in tension to the degree desired and the full benefit of the present invention will not be realized.

Figure 2A:
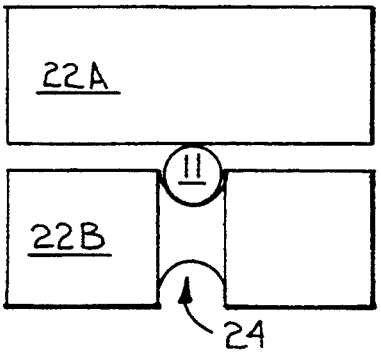
FIGS. 2A and 2B are an illustration of the construction of the rollers of the pusher system.
Figure 2B:
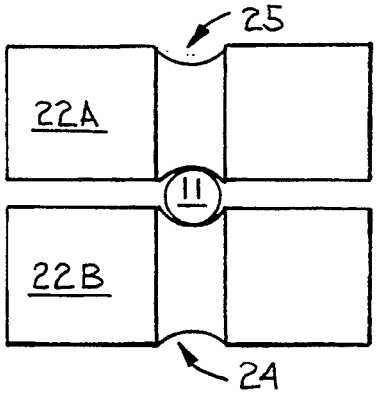

FIGS. 2A and 2B are an illustration of the construction of the rollers of the pusher system. The pusher system may be used by itself, or it may be used in conjunction with a puller system. In the embodiment of FIG. 2A, one of the rollers 22, such as roller 22B, has a U-shaped groove 24 around its circumference. Wire 11 sits in the groove and the pressure control device 23 (FIG. 1) causes rollers 22A and 22B to tend to come together, but they are restrained from doing so by the presence of wire 11. Rollers 22 are made out of A-10 tool steel hardened to about 61/62 Rockwell C. The groove 24 has a width approximately 1 mil wider than the outer diameter of wire 11 and has a depth which is a few mils greater than one half the outer diameter of wire 11. The width of groove 24 is such that groove 24 perfectly fits wire 11 and the depth of groove 24 is such that the center line of wire 11 is just beneath the surface of roller 22. Rollers 22A and 22B, including the surfaces of groove 24, are polished, such as by using jeweler's rouge, to a surface finish smoothness of 32–63 microinches. Rollers 22 are nominally one inch in diameter and, when wire 11 is present, are separated by approximately 35 mils. The dimensions of groove 24 were selected so that groove 24 firmly grips wire 11 with minimal pressure being applied by pressure control device 23. The less the pressure applied by pressure control device 23 the less likely that wire 11 will be deformed in any way. The surface smoothness, especially inside groove 24, allows rollers 22 to slip with respect to wire 11 without causing damage to wire 11. If the surfaces of groove 24 are not sufficiently smooth then galling, shaving, or other damage to wire 11 may occur when rollers 22 slip with respect to wire 11. As previously indicated, any damage to or deformation of wire 11 can cause pieces of or powder from wire 11 to form, to be dragged along with wire 11, and eventually to jam the wire guide or, more commonly, the tip 15 (FIG. 1). The very smooth surfaces of groove 24 and the part of roller 22A which contacts wire 11 allow rollers 22 to slip with respect to wire 11 without causing damage to wire 11. The precise fit of groove 24 to wire 11 minimizes the pressure needed between rollers 22 and therefore minimizes the deformation of wire 11. The construction of rollers 22 therefore provides for wire 11 to be firmly gripped and fed without damage or deformation when a jam or block is not present and also allows rollers 22 to slip with respect to wire 11 when a jam or block is present, thereby preventing the collapse of wire 11 and birdnesting.

FIG. 2B illustrates an embodiment wherein roller 22B has a groove 24 around its circumference and roller 22A has a groove 25 around its circumference. In this case, the depth of groove 24 and the depth of groove 25 should be selected so as to provide approximately 35 mils separation between rollers 22A and 22B when wire 11 is present. The center line of wire 11 may be below the surface of roller 22A, below the surface of roller 22B, or between the surfaces of rollers 22A and 22B, as desired. Grooves 24 and 25 have dimensions which are approximately one mil larger than wire 11 and are polished to the above mentioned surface smoothness. The principles of operation and the benefits of the use of the rollers in FIG. 2B are the same as those in the rollers of FIG. 2A. However, the two grooves 24, 25 may provide slightly better gripping of wire 11 than the single groove 24 of FIG. 2A and therefore allow even less pressure to be exerted by pressure control device 23.

Figure 3A:
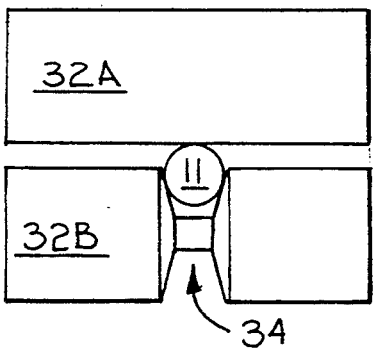
FIGS. 3A and 3B are an illustration of the construction of the rollers of the puller system.
Figure 3B:
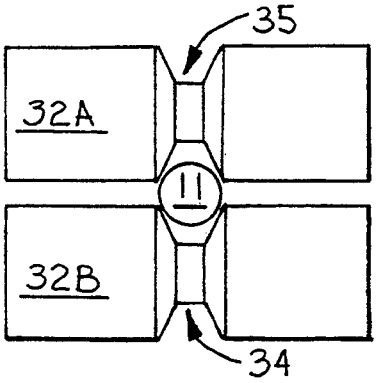

FIGS. 3A and 3B are an illustration of the construction of the rollers of the puller system. The pusher rollers 32 have a nominal diameter of 13/16 inch. This diameter is not critical and the reason for making the puller rollers 32 smaller than the pusher rollers 22 is that the puller rollers 32 are in the welding gun and, for the convenience of the welding operator, it is desirable to minimize the size and weight of the puller rollers 32. The puller rollers 32, like the pusher rollers 22, are constructed from A-10 tool steel and are hardened to a hardness of approximately 61/62 Rockwell C. However, unlike the pusher rollers 22, the puller rollers 32 have a normal machine finish and are not highly polished. The reason for this is that it is undesirable for rollers 32 to slip with respect to wire 11. Rollers 32 should preferably stay fixed to wire 11 so that motor 30 (FIG. 1 ) stalls out in the event of a jam or blockage. Because rollers 32 have a less smooth surface than rollers 22 motor 30 is designed to stall out so that rollers 32 do not slip with respect to wire 11. If rollers 32 slip on wire 11 then damage to wire 11 may occur. When wire 11 is present, rollers 32A and 32B should be separated by approximately 35 mils. One of the rollers, such as roller 32B, has a flat-bottomed V-shaped groove 34 around its circumference. Groove 34 has an inward taper of approximately 4° on each wall and a depth so that the bottom of groove 34 is approximately 25 to 35 mils below the bottom of wire 11. Therefore, wire 11 is firmly wedged in groove 34 without being deformed and the centerline of wire 11 is preferably just below the surface of roller 32B.

FIG. 3B illustrates the situation wherein roller 32B has a groove 34 around its circumference and roller 32A has a groove 35 around its circumference. Both grooves 34 and 35 are preferably flat-bottomed V-shaped grooves with an inward taper of 4° on each wall. Grooves 34 and 35 may be constructed so that the center line of wire 11 is below the surface of roller 32B, below the surface of roller 32A, or between the surfaces of rollers 32A and 32B, as desired. The use of two grooves, 34 and 35, provides more contact with wire 11 than a single groove 34 and therefore minimizes the possibility of rollers 32 slipping on wire 11 while using the least amount of pressure to grip wire 11.

The preferred implementation is to use one grooved roller, as shown in FIG. 2A, for the pusher rollers and to use two grooved rollers, as is shown in FIG. 3B, for the puller rollers.

Returning now to FIG. 1, the preferred operation of the present invention will be described. Motor control device 21 is adjusted so that motor 20 feeds wire 11 at the desired rate for the immediate welding operation and will not stall. Pressure control device 23 is adjusted so that rollers 22 will slip on wire 11 if wire 11 becomes jammed or blocked. Motor control device 31 is adjusted so that motor 30 feeds wire 11 to the welding operation at the desired speed but will stall out if wire 11 is jammed or blocked or otherwise will not feed. Pressure control device 33 is adjusted so that there is minimum deformation of wire 11 but also so that rollers 32 will not slip on wire 11.

In a normal operation, when the welding operator pulls the trigger (not shown) motor 30 will be activated first, thereby pulling out any slack in wire 11, and then motor 20 will be activated, thereby causing wire 11 to feed at the desired rate. It will be appreciated that, in this configuration, motor 20 is the controlling motor and sets the wire feed speed as motor 30 is a slave motor and feeds wire 11 at a rate determined solely by motor 20. Motor 20 sets the wire feed speed, rollers 32 do not slip on wire 11, and motor 30 is configured to operate as a limited torque motor, so motor 30 operates at a speed which is determined by motor 20.

When the welding operation is finished and the welding operator releases the trigger, motor 20 will be deactivated, thereby stopping the feeding of wire 11. However, the limited torque motor 30 is still operating and will continue pulling on wire 11, thereby assuring that any slack in wire 11 is taken out. Then, motor 30 will be deactivated and wire 11 will be held in tension between pusher system 12 and puller system 14.

Assume now that tip 15 has been blocked due to debris of one form or another. When the welding operator pulls the trigger motor 30 will be activated and then motor 20 will be activated. However, because tip 15 is blocked, wire 11 will not be able to move and, because rollers 32 cannot slip on wire 11, motor 30 will stall out. Also, although pusher system 12 may push a small amount of wire 11 into wire guide 13, the design and construction of rollers 22 is such that the additional resistance of the extra wire 11 in wire guide 13 and the surface smoothness of rollers 22 will cause rollers 22 to slip on wire 11. This will prevent the actual collapse of wire 11 in wire guide 13 or the spooling out of wire 11 (birdnesting) inside pusher unit 12 or puller unit 14. Birdnesting is prevented because, with the polished surfaces of rollers 22, rollers 22 will begin to slip on wire 11 and will be unable to exert enough force on wire 11 to cause wire 11 to buckle and form a birdnest in pusher unit 12 or puller unit 14. At this point the welding operator simply removes and replaces tip 15, cutting off a portion of wire 11 if necessary. Then, when the welding operator pulls the trigger motor 30 will be activated first and pull out any slack of wire 11 which may be present, such as that slack provided during the interval between the time the jam occurred and the time that rollers 22 began slipping on wire 11.

To achieve the result described above, pusher system 12 and puller system 14 are adjusted as described below. It is preferred that puller unit 14 be adjusted first. Motor control device 31 is adjusted so that the no load speed of motor 30 is higher than the desired actual feed rate. Pusher system 12 is disabled so that motor 20 does not feed wire 11. Tip 15 is blocked, such as by placing a piece of wood over the tip, and the trigger is pulled to activate puller system 14. Then, with the tip blocked, pressure control device 33 is adjusted so that the pressure exerted by rollers 32 prevents rollers 32 from slipping on wire 11 and therefore causes motor 30 to stall.

Then, to adjust pusher system 12, systems 12 and 14 are activated and an obstacle, such as a wood block, is placed a few inches in front of tip 15. Motor control device 21 is adjusted so that motor 20 provides the desired feed speed when rollers 22 are not slipping on wire 11. Pressure control device 23 is then adjusted so that rollers 22 exert a sufficient force on wire 11 to cause wire 11, where it exits tip 15, to form loops or curls having a diameter of approximately one inch and so that, when tip 15 is completely blocked, such as by bringing the block of wood against the tip, rollers 22 will slip on wire 11.

The settings for motor control devices 21 and 31 are preferably determined empirically and the units 12 and 14 marked or a table, provided, indicating the proper setting for a desired type of wire and wire feed speed. The adjustment of pressure control devices 23 and 33 is preferably done manually each time the size or the type of the wire is changed.

As previously noted, U.S. Pat. No. 3,293,477 discloses an apparatus which starts motor 30 before motor 20 and stops motor 20 before motor 30, thereby maintaining wire 11 in tension. However, motor braking may be used to maintain wire 11 in tension even if power to motors 20 and 30 is turned off at the same time. It well known to use a braking resistor to control the speed of braking of a motor. Braking resistor 26 is used to control the braking rate of motor 20, and braking resistor 36 is used to control the braking rate of motor 30. Braking resistors 26 and 36 are adjusted so that motor 20 brakes more rapidly than motor 30 and, as a result, wire 11 is maintained in tension. The values for resistors 26 and 36 are determined experimentally and, once set, need not be adjusted. The braking resistors may be used alone but are preferably used in conjunction with a time-delay sequencing circuit. The use of braking resistors has the advantage that it simplifies the circuitry and increases the reliability of the circuitry as compared with the use of only time-delay sequencing circuitry, such as that described in U.S. Pat. No. 3,293,477.

From the above, it will be appreciated that the present invention is an apparatus for a wire feeder, and a method for adjusting same, which minimizes the probability of and the effects of a jam or blockage in the wire travel path. The present invention uses minimal pressure on the wire so that deformation of the wire is minimized. The pusher system is designed and adjusted to slip on the wire without causing damage to the wire. The surfaces of the rollers in the pusher system which are in contact with the wire are polished to a high degree of smoothness so that it is possible for the rollers to slip on the wire without damaging the wire. The surfaces of the rollers in the puller system, which do not slip on the wire, are driven by a torque limited motor which will stall if the wire is blocked. The wire is maintained in tension either by using existing time-delay sequencing techniques for starting and stopping the motors, by selecting the rate of braking on each motor so that the pusher system motor stops before the puller system motor, or both. From the above, other embodiments of the present invention will suggest themselves to those of skill in the art. Therefore, the scope of the present invention is to be limited only by the claims below.

I claim:

1. A wire feeder for feeding a wire, comprising:

a first motor;

a first motor control means for controlling said first motor;

a first pair of rollers for feeding said wire, said first pair of rollers being driven by said first motor, said rollers of said first pair being in parallel and being separated by said wire, said rollers of said first pair having a selected surface finish, said surface finish being sufficiently smooth to prevent damage to said wire when said rollers of said first pair slip on said wire;

a first pressure control means, for controlling the pressure said first pair of rollers exerts on said wire, to prevent said first pair of rollers from slipping on said wire when said wire is not restrained and to allow said first pair of rollers to slip on said wire when said wire is restrained;

a second motor having a selected stalling torque;

a second motor control means for controlling said second motor;

a second pair of rollers for feeding said wire, said second pair of rollers being driven by said second motor, said rollers of said second pair being in parallel and being separated by said wire, said wire being fed between said second pair of rollers and said first pair of rollers; and a second pressure control means, for controlling the pressure said second pair of rollers exerts on said wire, to prevent said second pair of rollers from slipping on said wire when said second motor is applying said stalling torque and said wire is restrained.

2. The wire feeder of claim 1 wherein said second motor provides a second rate of braking, and further comprising a second braking resistor for controlling said rate of braking of said second motor.

3. The wire feeder of claim 1 wherein a selected one of said rollers of said second pair of rollers has a V-shaped groove around the circumference of said selected roller, said groove having a width approximately equal to the diameter of said wire at a point below the surface of said roller, such that a portion of said wire protrudes above the surface of said roller when said wire is in said groove.

4. The wire feeder of claim 1 wherein a selected one of said rollers of said second pair of rollers has a flat-bottomed, V-shaped groove around the circumference of said selected roller, said groove having a width approximately equal to the diameter of said wire at a point below the surface of said roller, such that a portion of said wire protrudes above the surface of said roller when said wire is in said groove, said groove having a depth such that said wire does not bottom out on said groove when said wire is inserted into said groove.

5. A wire feeder for feeding a wire, said wire having a predetermined diameter, comprising:

a motor;

motor control means for controlling said motor;

a pair of rollers for feeding said wire, said rollers being driven by said motor, said rollers being in parallel and being separated by said wire, said rollers having a selected surface finish, said surface finish being sufficiently smooth to prevent damage to said wire when said rollers slip on said wire, a selected one of said rollers having a U-shaped groove around the circumference of said selected roller, said groove having a width approximately equal to said diameter of said wire and having a depth greater than one-half of said diameter of said wire but less than said diameter of said wire; and pressure control means, for controlling the pressure said rollers exert on said wire, to prevent said rollers from slipping on said wire when said wire is not restrained and to allow said rollers to slip on said wire when said wire is restrained.

6. The wire feeder of claim 5 wherein said motor provides a rate of braking, said rate of braking being controllable, and further comprising a braking resistor for controlling said rate of braking of said motor.

* * * * *